US007966988B2

(12) United States Patent
Weldon et al.

(10) Patent No.: US 7,966,988 B2
(45) Date of Patent: Jun. 28, 2011

(54) METHOD FOR CONTROLLING SOOT INDUCED LUBRICANT VISCOSITY INCREASE

(75) Inventors: Brandon T. Weldon, Cherry Hill, NJ (US); Steven Kennedy, West Chester, PA (US); Riccardo Conti, Brigantine, NJ (US); Jeffrey R. Torkelson, Woolwich, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 858 days.

(21) Appl. No.: 11/323,273

(22) Filed: Dec. 30, 2005

(65) Prior Publication Data

US 2006/0150943 A1 Jul. 13, 2006

Related U.S. Application Data

(60) Provisional application No. 60/642,862, filed on Jan. 11, 2005.

(51) Int. Cl.
*F01M 5/00* (2006.01)

(52) U.S. Cl. ..... 123/196 AB

(58) Field of Classification Search ..... 123/196 AB, 123/196 R, 196 ASB; 184/6.22, 6.21; 208/177, 208/179, 180

See application file for complete search history.

(56) References Cited

U.S. PATENT DOCUMENTS

| | | | | |
|---|---|---|---|---|
| 1,334,844 | A * | 3/1920 | Day | 184/6.22 |
| 1,920,012 | A * | 7/1933 | Good | 123/196 AB |
| 2,262,527 | A * | 11/1941 | Beare et al. | 123/196 A |
| 3,356,182 | A * | 12/1967 | Robinson et al. | 184/6.21 |
| 4,506,505 | A * | 3/1985 | Melzer | 60/278 |
| 4,512,300 | A * | 4/1985 | DeVore et al. | 123/196 AB |
| 4,815,431 | A * | 3/1989 | Yorita et al. | 123/196 AB |
| 5,018,490 | A * | 5/1991 | Kroner | 123/196 AB |
| 5,159,910 | A * | 11/1992 | Ninomiya et al. | 123/196 AB |
| 5,168,845 | A * | 12/1992 | Peaker | 123/196 AB |
| 5,937,801 | A * | 8/1999 | Davis | 123/41.33 |
| 6,053,143 | A | 4/2000 | Taylor | |
| 6,695,470 | B1 * | 2/2004 | Berndorfer et al. | 374/45 |
| 2002/0148433 | A1 * | 10/2002 | Rossiter | 123/196 AB |
| 2003/0230274 | A1 * | 12/2003 | Williams et al. | 123/196 R |
| 2004/0007403 | A1 * | 1/2004 | Tomatsuri et al. | 180/65.2 |
| 2004/0040789 | A1 | 3/2004 | Rake et al. | |

FOREIGN PATENT DOCUMENTS

| | | |
|---|---|---|
| WO | WO 96/25996 | 8/1996 |

* cited by examiner

*Primary Examiner* — M. McMahon
(74) *Attorney, Agent, or Firm* — Gary Katz

(57) ABSTRACT

Periodically heating a soot containing engine lubricant to a temperature in the range of about 115° C. to about 150° C. is effective in controlling soot induced viscosity increase of the lubricant. The period at which heating is conducted may be a function of the number of hours the engine has been operated or it may be based on the oil condition.

9 Claims, 6 Drawing Sheets

METHOD FOR CONTROLLING SOOT INDUCED LUBRICANT VISCOSITY INCREASE

This application claims the benefit of U.S. Provisional Application 60/642,862 filed Jan. 11, 2005.

FIELD OF THE INVENTION

This invention relates to a method for controlling soot induced viscosity increase of lubricating oils.

BACKGROUND OF THE INVENTION

Internal combustion engines, such as automobile engines, include many mechanical elements such as pistons, shafts, and bearings, that rotate or slide against one another and that require proper lubrication to decrease friction, reduce wear and dissipate heat. For this reason, a lubricating oil system is provided for the engine to supply lubricating oil to these mechanical parts.

It is common practice today in designing internal combustion engines to provide for exhaust gas recirculation to reduce engine emissions. Experience has shown, however, that such engine designs tend to place increased stress on the engine lubricant. One of these stresses is the soot loading of the engine oil. Oil filters and recyclers of various designs have been an integral part of internal combustion engines as a way of removing contaminants from the engines recirculating lubricant to maintain the usefulness of the oil. Such devises, however, fail to rectify the soot loading problem. Presently, to prevent soot agglomeration and concomitant thickening of the engine oil, engine oils are formulated with dispersant viscosity modifiers to aid in the dispersion of the soot. While use of these additives increases lubricant life there still are soot levels in oils which result in loss of viscosity control.

Accordingly one object of the present invention is to provide improvements in controlling soot induced viscosity increase in lubricating oils.

Another object of the invention is to provide a method for reversing soot induced viscosity increase once it has occurred.

These and other objects of the invention will become apparent from what follows herein.

SUMMARY OF THE INVENTION

Surprisingly it has been found that by periodically heating a soot containing engine lubricant to a temperature in the range of about 115° C. to about 150° C. soot induced viscosity increase of the lubricant can be controlled and even reversed.

The period at which heating is conducted may be a function of the number of hours the engine has been operated, or it may be based on determining the condition of the lubricant by measuring the soot content or detecting viscosity increase of the lubricant.

DETAILED DESCRIPTION OF THE INVENTION

Figure 1:
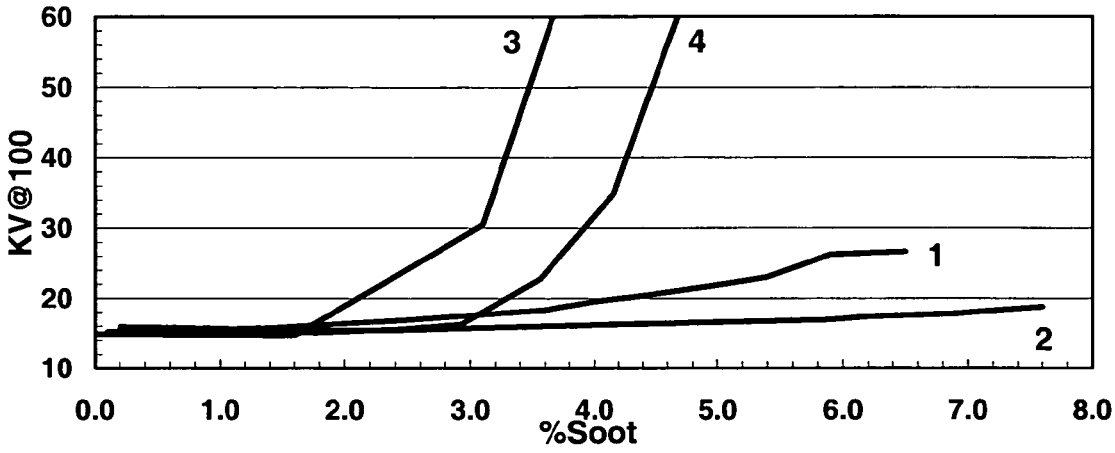
FIG. 1 is a graph showing viscosity increase vs the percent soot in oils subjected to standard industry tests and an oil actually used in the field.

FIG. 1 illustrates that lubricating oils that meet standard industry engine requirements for soot induced viscosity control do not necessarily perform satisfactorily under actual engine operating conditions in the field. In the graph Mack T-8E test results (line 1) and the Mack T-10 test results (line 2) for an oil meeting the API CI-4 classification grade is compared with the results obtained for an engine actually used in the field (line 3). The Mack T-8E evaluates the soot handling capability of engine lubricants with regard to viscosity; this is done to simulate heavy-duty, stop-and-go operation with high soot loading. The test runs for 300 hours with oil samples being taken every 25 hours. The pass/fail criteria of the test includes a maximum viscosity at 3.8% soot of 11.5 cSt (11.5, 12.5, 13.0 cSt for 1, 2, 3 tests). The Mack T-10 test evaluates the oil's ability to minimize cylinder liner, piston ring, and bearing wear in engines with exhaust gas re-circulation systems (EGR). The pass/fail criteria include measurements of both oxidation level and oil consumption. While not a direct study of the soot-viscosity interaction, the test parameters do provide a higher soot loading rate than that of the Mack T-8E. To address the discrepancy shown in FIG. 1 between the standard test results and field experience, the Mack-11 test was developed. The Mack T-11 evaluates the soot handling capability of engine lubricants under fixed EGR conditions (~17% EGR). In addition to the soot loading rate being slightly slower than that of the Mack T-8E, the oil gallery temperature is controlled at 88° C. (the Mack T-8E oil gallery temperature is not controlled). As can be seen in FIG. 1 the same oil that performs well in the Mack T-8E (line 1) and Mack T-10 (line 2) tests performs poorly in the Mack T-11 test (line 4). The performance criteria for passing the Mack T-11 test is for an oil to exhibit a viscosity increase of no more than 12 cSt at 100° C. at 6 wt % soot content.

According to the invention periodically heating a soot containing engine lubricant to a temperature in the range of about 115° C. to about 150° C., and preferably 130° C. to 135° C., soot induced viscosity increase of the lubricant can be controlled and even reversed.

Figure 2:
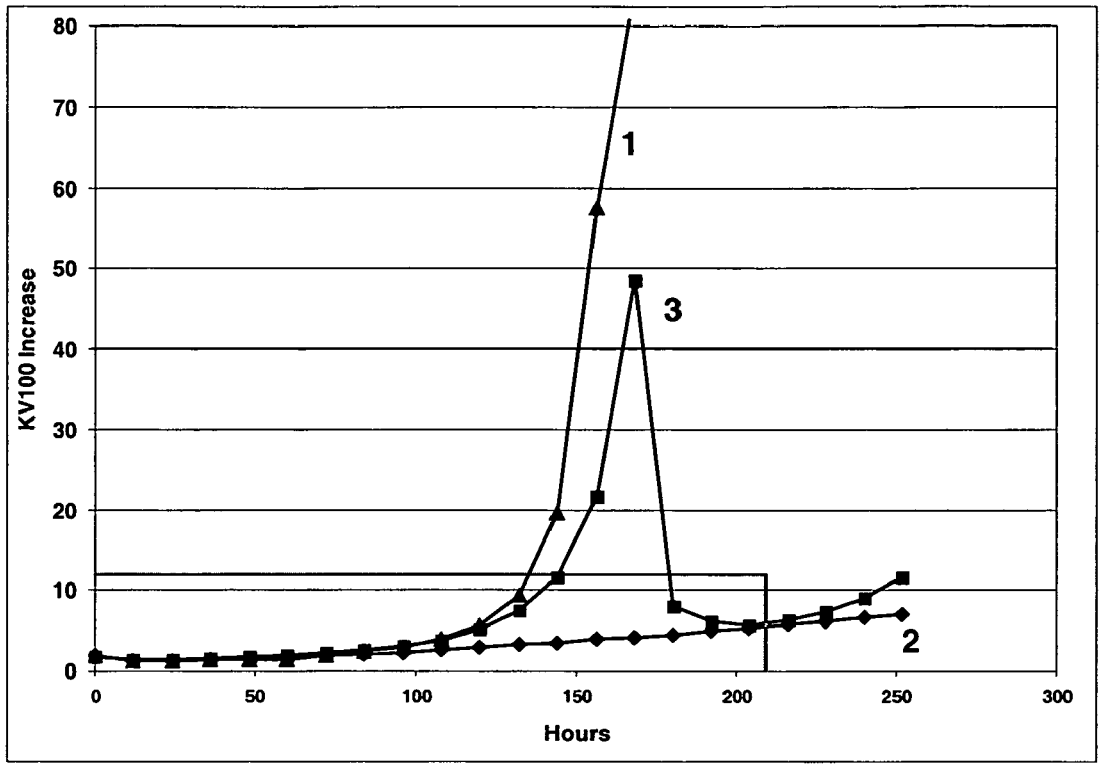
FIG. 2 is a graph showing the effect of heat treatment according to the invention on viscosity control.

FIG. 2 illustrates the change in viscosity for an oil under standard Mack T-11 test conditions (line 1) where sump temperature is maintained at about 95° C. compared to the change in viscosity for the same oil where sump temperature was maintained at 135° C. (line 2). Indeed, the oil of line 2 maintained viscosity control up to about 16 wt % soot content. In another test the oil was maintained at the standard Mack T-11 conditions, i.e., a sump temperature of about 95° C. until the viscosity began to break; at this point the sump temperature was raised to 135° C. and viscosity control returned to the oil (line 3).

In general, the engine lubricant may be maintained by a variety of means at temperatures between 115° C. to 150° C., and preferably between 130° C. to 135° C. consistently to ensure greatest soot-viscosity control. Alternatively, the sump oil temperature may be periodically raised to a range of 115° C. to 150° C., and preferably to 130° C. to 135° C. by means of a heater in thermal contact with oil (as in the sump), a heater located exterior to the sump connected by means of a circulation system, or through the thermostatic control of the engine cooling system. In one embodiment the engine cooling control (thermostat) is automatically actuated to change temperature in response to engine operating conditions such as the number of hours the engine has been operating or by response to a sensor(s) monitoring the condition of the oil. In another embodiment the oil is periodically heated by circulating the oil through an oil heater, again automatically in response to engine operating conditions such as the number of hours the engine has been operating or in response to sensor(s) that monitor(s) the condition of the oil. In yet another embodiment, an internal heater is automatically actuated in response to engine operating conditions such as the number of hours the engine has been operating or by response to a sensor(s) monitoring the condition of the oil.

Figure 3A:
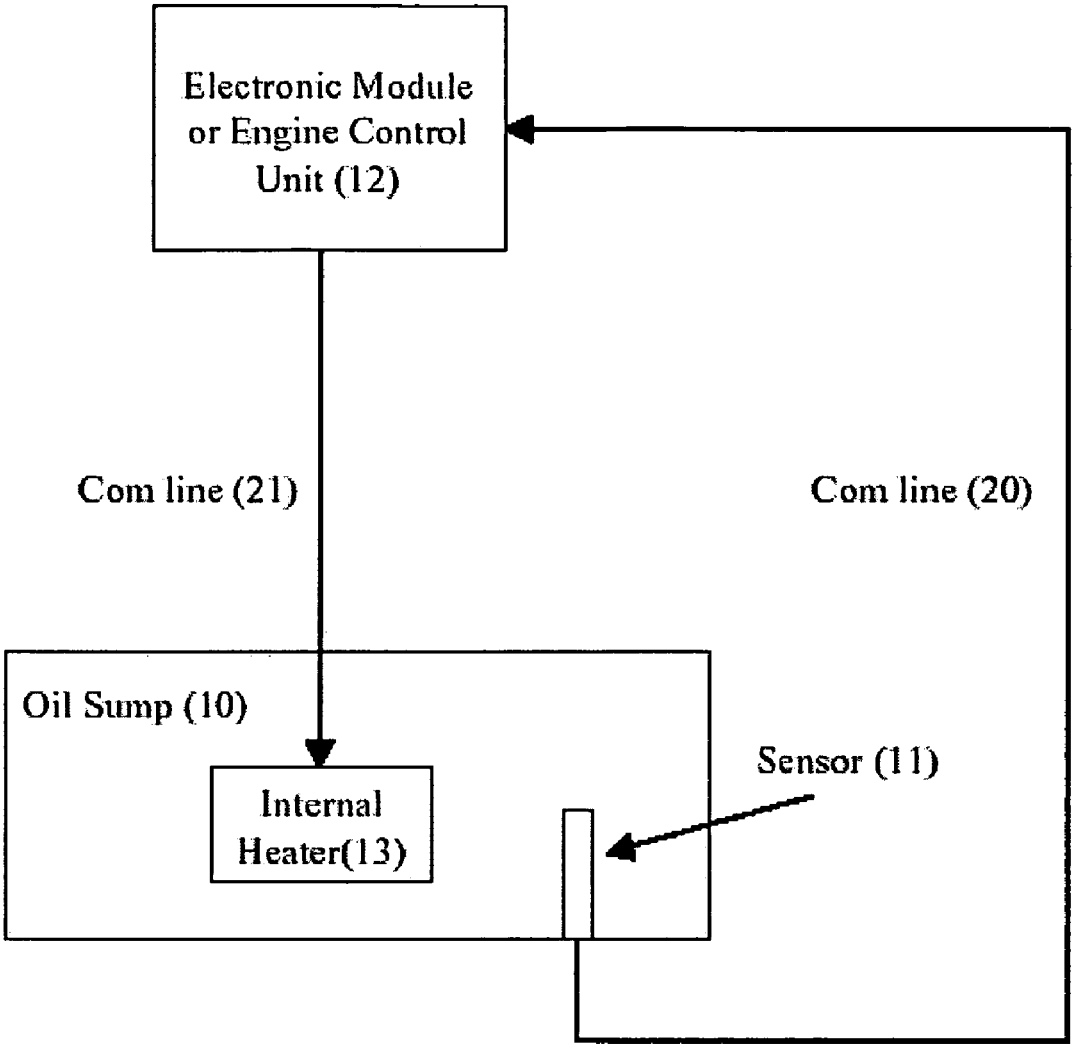
FIGS. 3*a*, 3*b* and 3*c* are block diagrams representing selected embodiments of the invention for controlling soot induced viscosity increase.
Figure 3B:
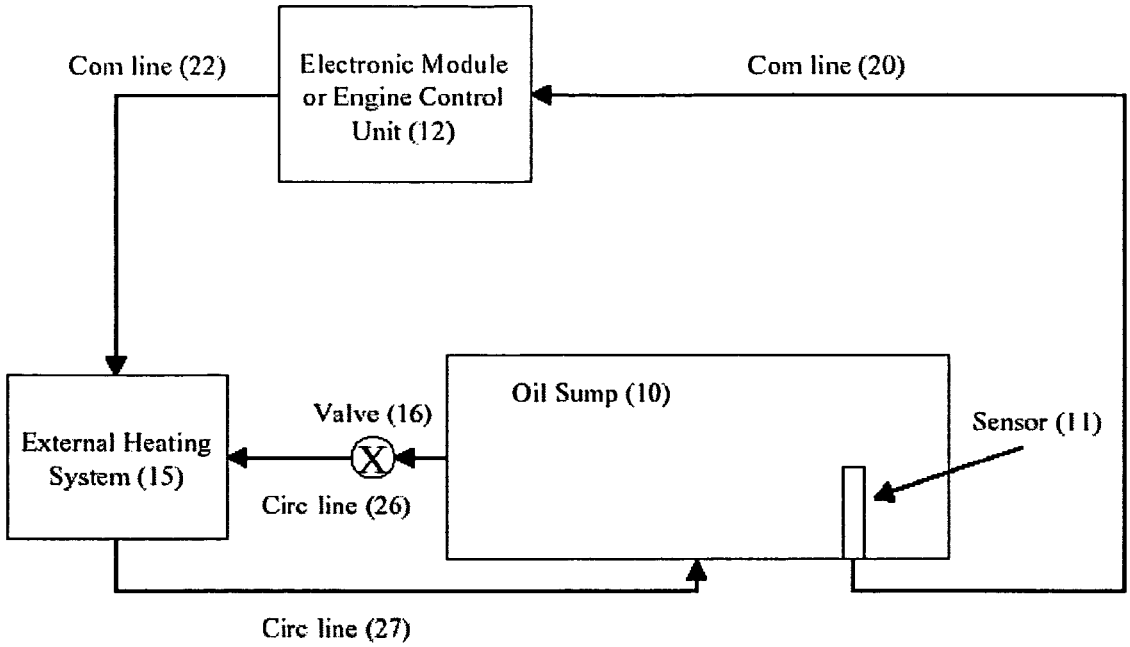
Figure 3C:
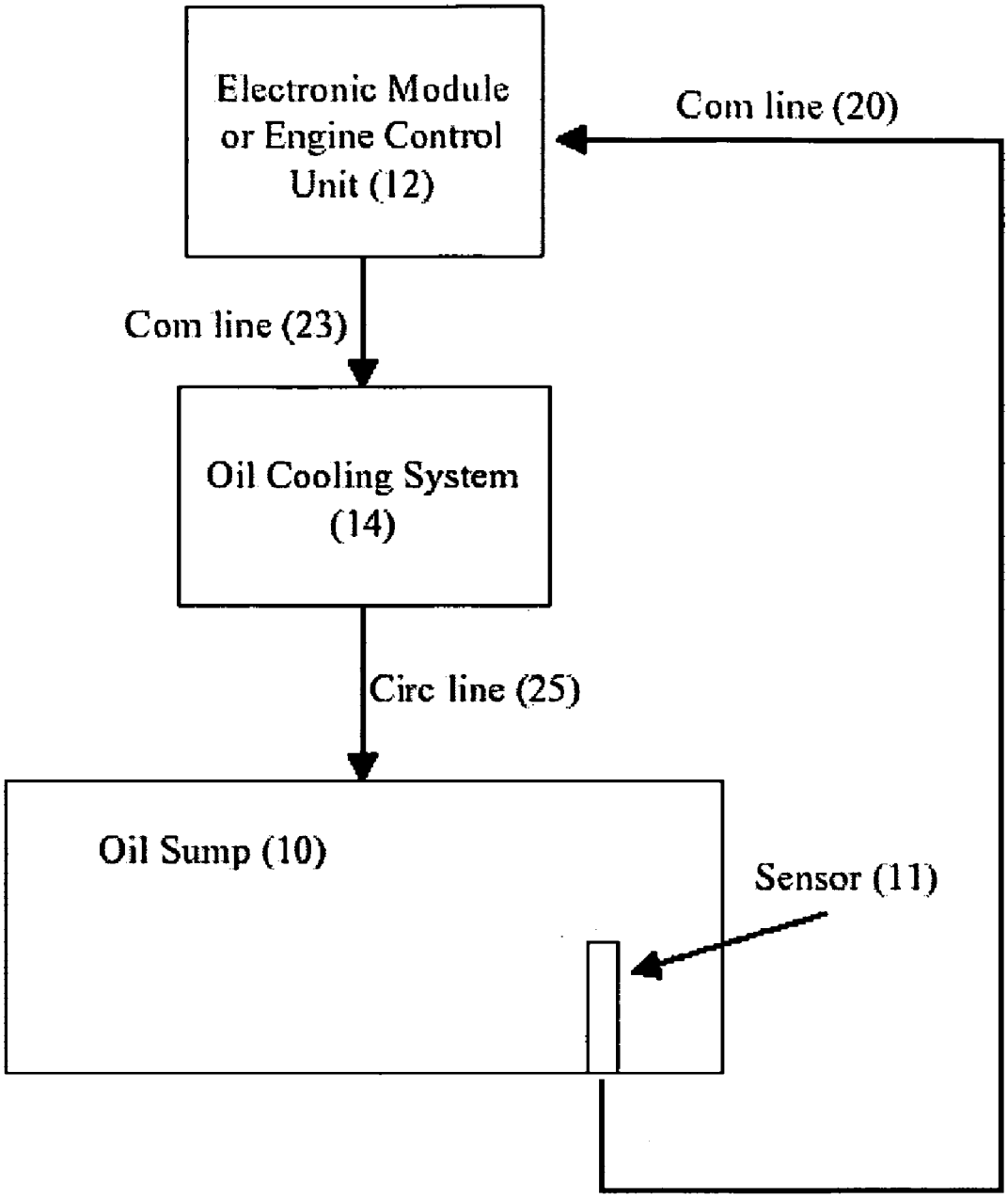

FIGS. 3*a*, 3*b* and 3*c* are block diagrams representing selected embodiments of the invention for periodically heating an engine oil to control soot induced viscosity increase. In each of FIGS. 3*a*, 3*b* and 3*c* a sensor 11 for detecting the condition of the engine lubricating oil is shown located in oil sump 10 and is in electronic communication with the electronic module or engine control unit 12 via communication line 20. Although sensor 11 is shown located in oil sump 10 it may be located in any location sufficient for detecting the oil condition such as in the engine block, oil circulating lines or the like. In the embodiment shown in FIG. 3*a* a heater 13 is located within oil sump 10 for periodically heating the oil to the requisite temperature. Oil heater 13 is in electronic communication with module 12 via communication line 21. When sensor 11 detects an oil condition, such as viscosity, which is determined by module 12 to require heating the oil in the sump to the temperature range for controlling the soot induced viscosity increase module 12 activates the heater 13 until sensor 11 signals module 12 that the oil has returned to a satisfactory condition.

In the embodiment of FIG. 3*b* an oil heater 15 is provided external sump 10 and oil is circulated via circulation lines 26 and 27 in response to an electronic signal from module 12 via communication line 22. Oil flow to the external heater 15 can be controlled through a valve 16. As with the previous embodiment oil is heated periodically when sensor 11 detects an oil condition requiring heating.

In the embodiment shown in FIG. 3*c* module 12 is in electronic communication with what is represented as the engine oil cooling system 14. (Basically coolant circulating through an engine controls the lubricant temperature therein.) In this embodiment oil returned to sump 10 via oil circulation line 25 is used to adjust the overall lubricant temperature. When the condition of the oil detected by sensor 11 is determined by module 12 to require heating, module 12 actuates the engine cooling system to effect a decrease in cooling of the oil circulating through the engine oil circulating system until sensor 11 detects an oil condition determined by module 12 to be satisfactory.

To better understand the embodiments described typical engine oil circulating system components such as oil pumps and filters have not been represented in FIGS. 3*a*, 3*b* and 3*c* nor are lines showing the flow of oil through the engine and return to an oil sump 10. Similarly the power source for heater 13 and 15 are not represented nor are read-outs and other obvious components of electronic control modules shown.

Figure 4:
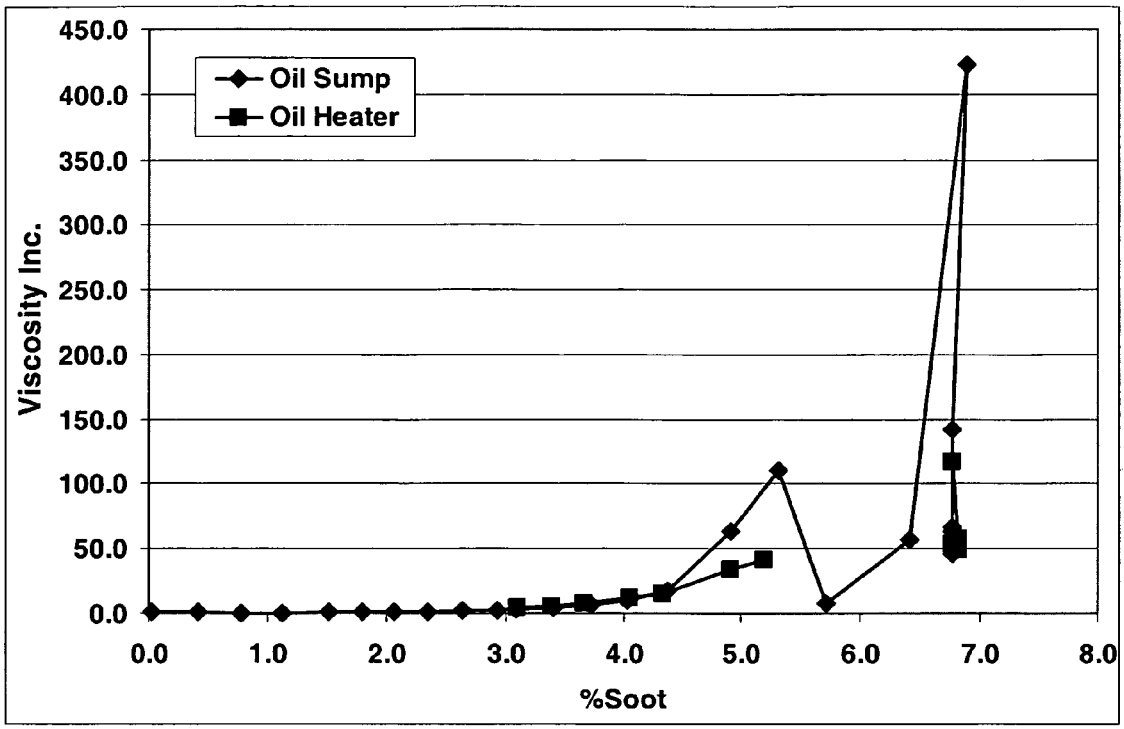
FIG. 4 is a graph illustrating an embodiment of the invention.

The benefit of heating circulating oil is illustrated in FIG. 4 in which viscosity increase vs % soot in the oil is shown for oil from the sump (the diamonds) and oil directly from the heater (the squares). For the purpose of this test the heater had been run constantly. In any event it can be seen that in this test the oil did not lose viscosity control until after 4+ wt % soot instead of the typical 3.5% soot under Standard Mack T-11 test conditions.

What is claimed is:

1. A method for controlling soot induced viscosity increase in an internal combustion engine lubricant comprising:

detecting one of the number of hours of engine operation, the soot content of the lubricant, and the viscosity increase of the lubricant;

comparing the detected condition to a predetermined condition;

when the detected condition exceeds the predetermined condition heating the oil to a temperature in the range of about 115° C. to about 150° C. for a time sufficient to reduce soot induced viscosity increase of the lubricant; and terminating the heating until the detected condition exceeds the predetermined condition when the heating process and terminating steps are repeated.

2. The method of claim 1 wherein the oil is heated to a temperature in the range of about 130° C. to about 135° C.

3. The method of claim 1 or 2 wherein the engine includes an oil sump and the oil is heated therein.

4. The method of claim 1 or 2 wherein the engine includes an oil sump and a portion of the oil is circulated from the sump through an oil heater and is returned to the sump.

5. The method of claim 1 or 2 wherein the engine includes a cooling system and the oil is heated by increasing the cooling temperature.

6. A method for controlling soot induced viscosity increase in an internal combustion engine lubricant comprising:

periodically heating the engine lubricant to a temperature in the range of about 115° C. to about 150° C. for a time sufficient to reduce at least 75% of any oil viscosity increase wherein the period at which the oil is heated is a function of the number of hours of engine operation.

7. The method of claim 6 wherein the oil is heated in the range of about 130° C. to about 135° C.

8. A method for controlling soot induced viscosity increase in an internal combustion engine lubricant comprising:

periodically heating the engine lubricant to a temperature in the range of about 130° C. to about 135° C. for a time sufficient to control soot induced viscosity increase which occurs over the life of the lubricant, wherein the period at which the oil is heated is a function of the number of hours of engine operation.

9. The method of claim 8 wherein the oil is heated for a time sufficient to reduce at least 75% of any oil viscosity increase.

* * * * *